US007765940B1

(12) United States Patent
Peterson

(10) Patent No.: US 7,765,940 B1
(45) Date of Patent: Aug. 3, 2010

(54) EXTENSION FOR DESK

(76) Inventor: Graham Peterson, 705 Hooper Creek Rd., Tryon, NC (US) 28782

( * ) Notice: Subject to any disclaimer, the term of this patent is extended or adjusted under 35 U.S.C. 154(b) by 147 days.

(21) Appl. No.: 12/080,163

(22) Filed: Apr. 1, 2008

Related U.S. Application Data

(60) Provisional application No. 60/921,848, filed on Apr. 5, 2007.

(51) Int. Cl.
*A47B 9/00* (2006.01)

(52) U.S. Cl. ..... 108/144.11; 108/190

(58) Field of Classification Search ..... 108/153.1, 108/115, 144.11, 180, 186, 187, 190; 312/262, 312/258; 211/186, 188, 182, 189; 248/188, 248/188.2, 188.6, 166, 188.1, 436
See application file for complete search history.

(56) References Cited

U.S. PATENT DOCUMENTS

| | | | | |
|---|---|---|---|---|
| 1,053,357 | A | 2/1913 | Carter | |
| 1,583,161 | A * | 5/1926 | Malott | 312/198 |
| 2,544,822 | A * | 3/1951 | Brown | 312/351.3 |
| 2,545,949 | A * | 3/1951 | Fox | 312/351.3 |
| 2,750,243 | A * | 6/1956 | Zielfeldt | 108/78 |
| 3,006,706 | A | 10/1961 | Park et al. | |
| 3,009,752 | A * | 11/1961 | Margulis | 312/280 |
| 3,088,785 | A * | 5/1963 | Schuette | 312/195 |
| 3,229,790 | A * | 1/1966 | Shayne | 403/172 |
| 3,232,253 | A * | 2/1966 | Winters | 297/344.12 |
| 3,464,662 | A * | 9/1969 | Myers | 248/188 |
| 3,595,180 | A | 7/1971 | Swoyer | |
| 3,796,169 | A | 3/1974 | Bales et al. | |
| 5,333,825 | A * | 8/1994 | Christensen | 248/188.2 |
| 5,647,286 | A * | 7/1997 | Dunn | 108/147.21 |
| 5,678,706 | A | 10/1997 | Husak et al. | |
| 5,720,093 | A | 2/1998 | Yoder, Jr. | |
| 5,911,183 | A * | 6/1999 | Goto | 112/103 |
| 6,041,723 | A * | 3/2000 | Peterson | 108/115 |
| 6,044,990 | A | 4/2000 | Palmeri | |
| 6,173,660 | B1 * | 1/2001 | Emmert | 108/90 |
| 6,202,867 | B1 * | 3/2001 | Di Blasi et al. | 211/188 |
| 6,247,414 | B1 * | 6/2001 | Sikora et al. | 108/190 |
| 6,314,892 | B1 * | 11/2001 | Favini | 108/115 |
| 6,371,495 | B2 | 4/2002 | Thompson | |
| 6,547,264 | B1 * | 4/2003 | Blackburn | 280/47.35 |
| 6,752,090 | B2 * | 6/2004 | Schenker et al. | 108/115 |
| 6,902,074 | B2 * | 6/2005 | Albrecht | 211/189 |
| 6,923,410 | B2 | 8/2005 | Chang | |
| 7,267,309 | B2 | 9/2007 | Hanson | |
| 7,293,510 | B1 | 11/2007 | Siao | |
| 2004/0194678 | A1 * | 10/2004 | Waner | 108/147.21 |
| 2007/0221800 | A1 * | 9/2007 | Levin | 248/188.2 |

* cited by examiner

*Primary Examiner*—Janet M Wilkens
*Assistant Examiner*—Dan Rohrhoff
(74) *Attorney, Agent, or Firm*—McNair Law Firm; Cort Flint

(57) ABSTRACT

A kit for converting a standard sit-down desk to a stand-up desk. The kit includes a frame having a plurality of leg extensions secured with end rails and a plurality of side supports of selected length. Selected of the leg extensions are pivotally carried between retracted and extended positions. The kit also includes a foot rail, a shelf, a plurality of spacers and a plurality of collars. For shipping, the pivotable leg extensions, shelf and foot rail are placed parallel with the end rail. In use, the pivotable leg extensions are moved into an extended position and secured by the foot rail and shelf. The desk legs are interconnected with the leg extensions by the collars.

7 Claims, 4 Drawing Sheets

EXTENSION FOR DESK

CROSS REFERENCE TO RELATED APPLICATION

This application claims priority from a provisional application filed Apr. 5, 2007, under Application Ser. No. 60/921,848 entitled Stand-Up Desk Conversion Kit.

BACKGROUND OF THE INVENTION

It is well known that certain jobs requiring the use of a material support also requires that the user stand up. In certain instances, a podium is satisfactory; in other instances, a desk is required.

It has been found that there exists a need to convert standard desks into stand-up desks due to a lack of availability of stand-up desks.

Accordingly, it is an object of the present invention to provide means, which when incorporated with a standard desk, convert it into a stand-up desk.

Another object of the invention is to provide conversion means which blend with the structure of the standard desk.

Another object of the invention is the provision of adjustment members which are capable of locating the height of the adjusted desk to variable heights.

Another object of the invention is the provision of a kit for adjusting the height of a desk.

SUMMARY OF THE INVENTION

The invention is directed to a conversion kit for adjusting the length of the legs of a desk or table from standard length to the length of a stand-up desk or table. The kit includes a support frame including a plurality of leg extensions of selected length interconnected with side supports. The leg extensions are spaced to be aligned with the legs of the desk or table. There are provided a plurality of collars which are adapted to fit over the ends of the leg extensions and the legs of the desk or table uniting the support frame with the legs of the desk or table.

The kit further includes a foot rail which is adapted to be secured over opposed of the side supports and adjacent a forward pair of the leg extensions. A shelf, which is positionable adjacent a rear side of the support frame, is also provided. The foot rail and the shelf provide additional stability for the support frame.

The kit collars are preferably formed of metal and are colored to match the color of the legs. There are also provided a plurality of spacers which are sized to be positioned in the collars between the opposed ends of the legs and the leg extensions. The spacers provide further but more minute height adjustment.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

The invention is a means whereby a regular sit-down desk or table with standard legs may be converted to a stand-up desk or table of various heights. The invention consists of a basic frame which is preferably formed of the same material and has the same number of legs as the desk or table. The invention includes joining means or collars which engage with both the desk or table legs and the legs of the frame. The collars are preferably formed of metal or can be wood tubes which are colored or painted to match the frame and desk legs. Alternatively, the collars could be formed of wood, plastic or paper tubing. Additionally, spacers are provided to accommodate further and more minute height adjustments.

Figure 1:
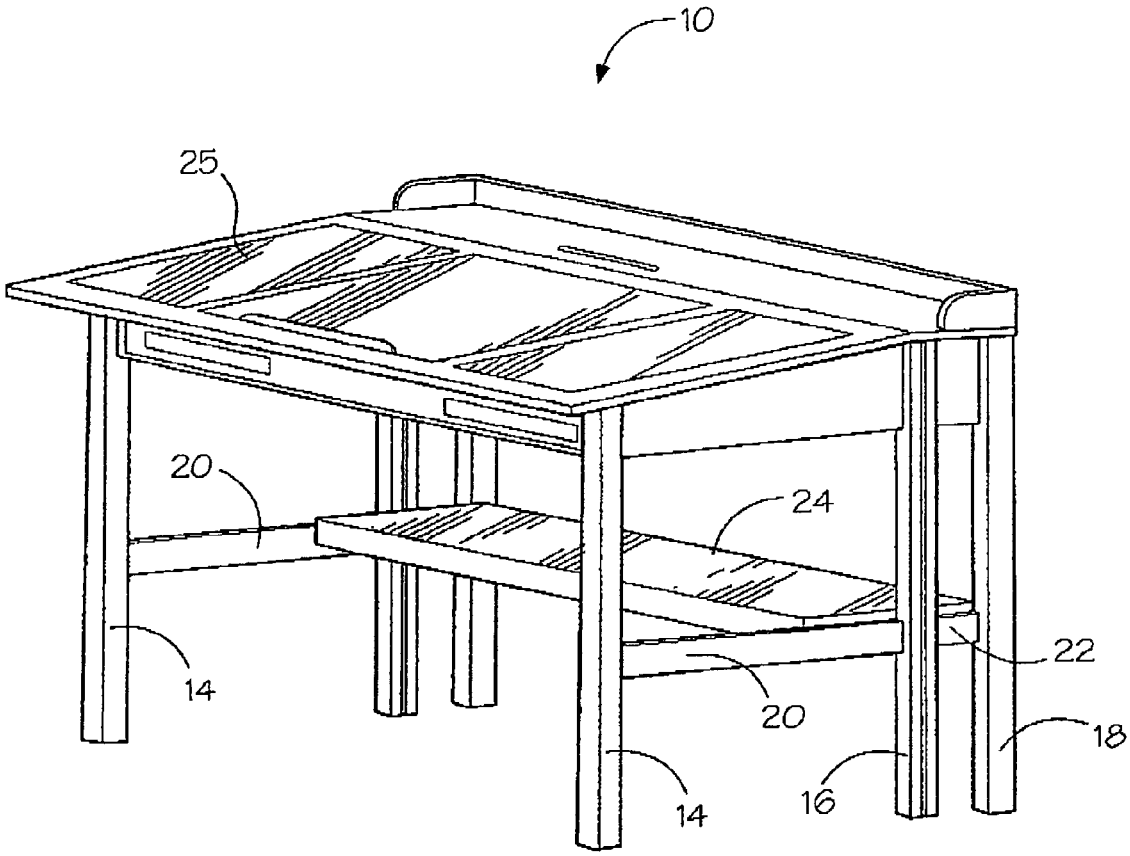
Fig. 1 PRIOR ART
FIG. 1 is a perspective view of a standard desk which may be elevated to a stand-up height.
Figure 2:
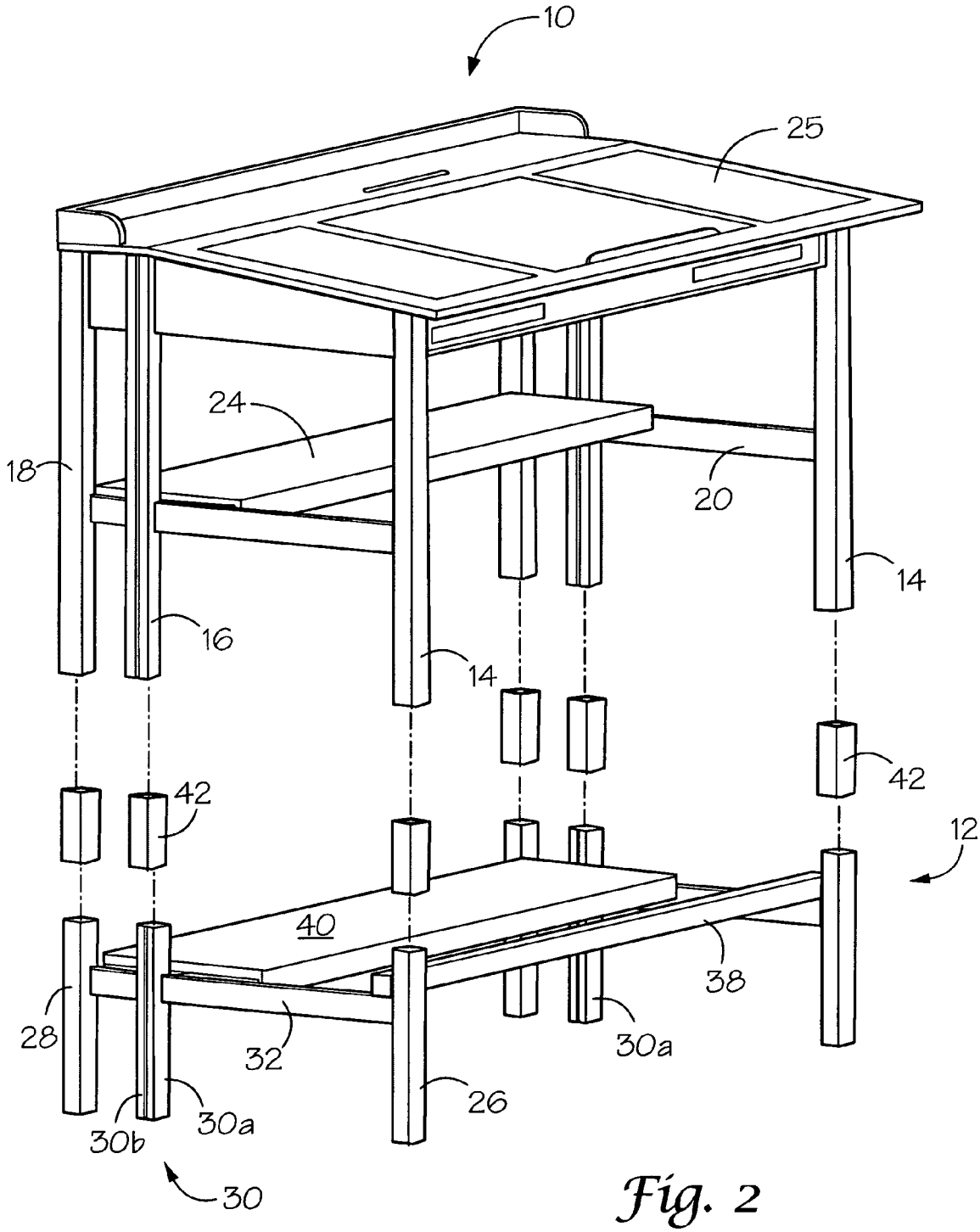
FIG. 2 is an exploded perspective view of a desk and the conversion kit positioned to be engaged.
Figure 3A:
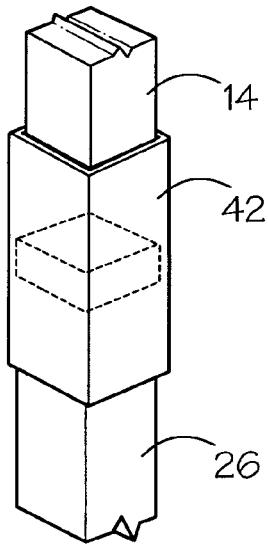
FIG. 3A is an exploded view of the collar of the invention combined with each leg and a spacer.
Figure 3B:
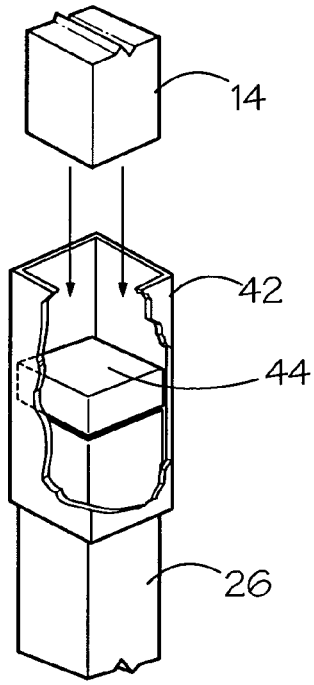
FIG. 3B is a cutaway exploded view similar to FIG. 3A.

Turning now to FIGS. 1 and 2, a standard desk 10 is shown to which the height adjust kit 12 has been attached. Desk 10 consists of usual components: legs 14, 16 and 18; side supports 20, 22; an end rail, not shown; supporting shelf 24; and top 25. Desk 10 is about 2.5' in height. The support frame leg extensions plus the spacers are designed to elevate the desk to between 3' and 4'.

Figure 5:
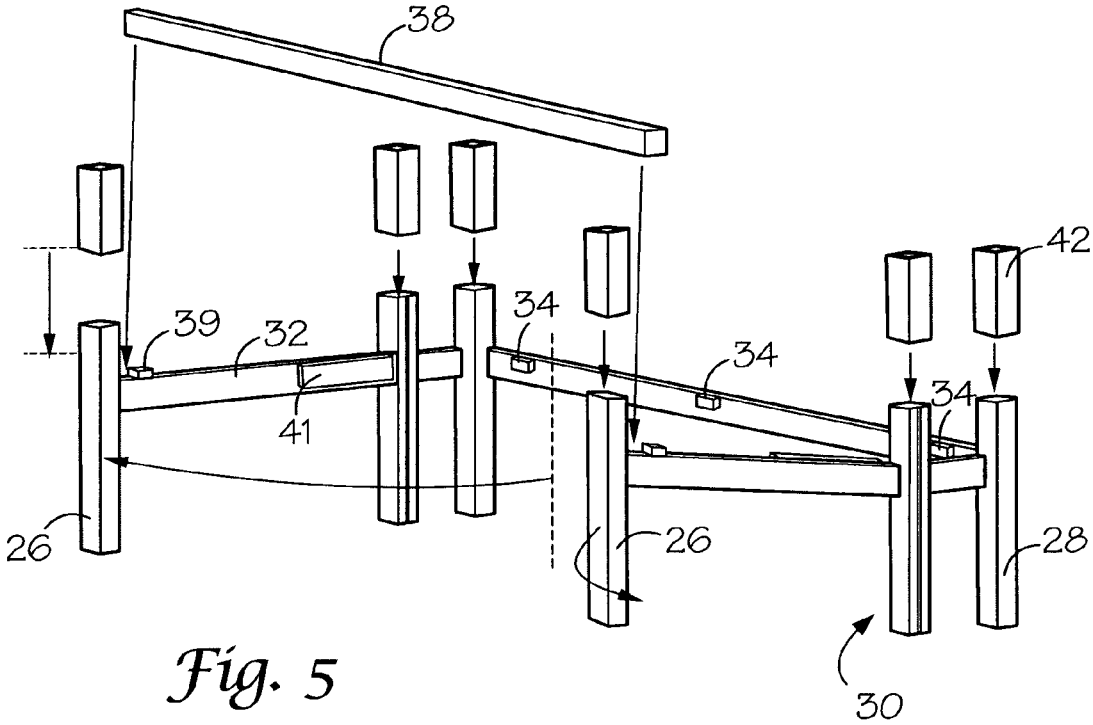
FIG. 5 is a perspective view of the conversion kit semi-assembled.
Figure 6:
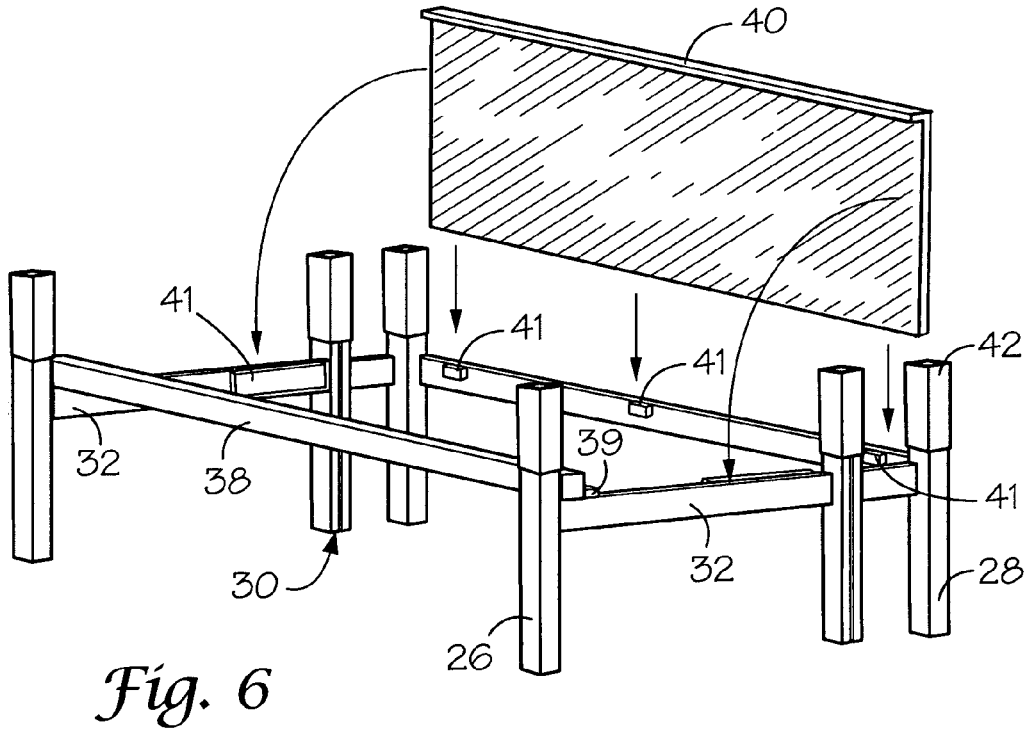
FIG. 6 is a perspective view of the conversion kit assembled with the leg extensions in extended position.

The conversion kit 12, as also seen in FIGS. 5 and 6, consists of a frame comprising a pair of front legs 26, a pair of rear legs 28, and a pair of hinged legs 30. The hinged legs comprise forward members 30*a* connected by hinges 36 with rear members 30*b*. Forward legs 26 are connected with forward members 30*a* of hinged leg 30 by side supports 32, which rear legs 28 are connected with rear members 30*b* of hinged legs 30 by side supports 33. An end rail 34 connects rear legs 28 in relative fixed position.

Figure 4:
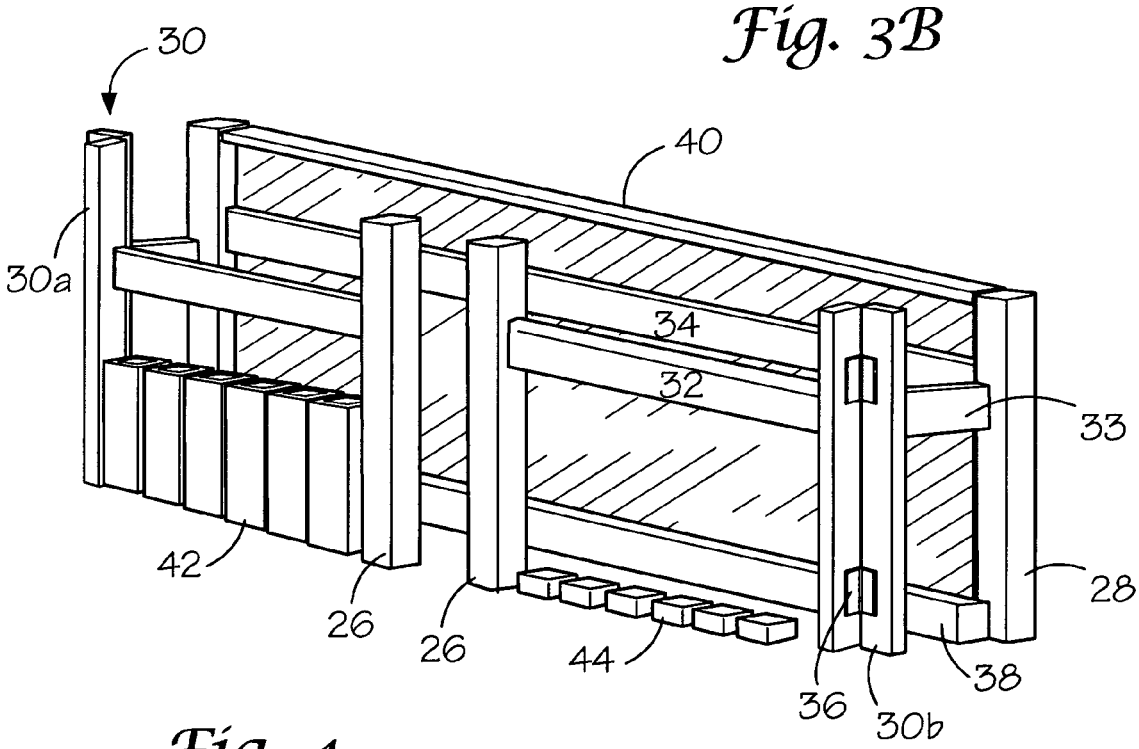
FIG. 4 is a perspective view of the conversion kit broken down for storage or shipping.

A pair of hinges 36 interconnected forward and rear members 30*a* and 30*b* in pivotal relationship. Hinge 36 allows side supports 32, along with forward legs 26, to be pivoted between first positions parallel with and adjacent end rail 34, as shown in FIG. 4, and into second positions perpendicular of and spaced from end rail 34 as seen in FIG. 6.

The frame includes foot rail 38 which is positioned on side supports 32 adjacent front legs 26 when legs 26 are in the second position and the conversion kit is positioned in the support or extended position as shown in FIG. 6. Blocks 39 may be attached to side supports 34 to retain the foot rail in position. Also, the ends of the foot rail may be notched to further assist in stabilizing the foot rail. Alternatively, the foot rail may be attached by screws. The kit is in its retracted or folded position when front legs 26 are pivoted into the first position adjacent end rail 34 as shown in FIG. 4.

The kit may also include a shelf 40 which is positioned inwardly between hinged legs 30 and rear legs 28. Strips 41 may be secured to the inner sides of side supports 32 and end rail 34 to support shelf 40 in fixed position. Alternatively, shelf 40 may be hinged to end rail 34.

It is noted that when in position, both foot rail 38 and shelf 40 act to stabilize the frame when in its support or extended position as shown in FIG. 2.

There are provided a plurality of collars 42, one for each leg extension, which are constructed to fit over the lower end of legs 14, 16, 18 and the upper ends of leg extensions 26, 28, 30. The collars are preferably made of metal and are sized to lightly slip over the legs and leg extensions. Set screws can then be inserted in the upper and lower end of each collar securing the desk 10 and conversion kit 12 together and allowing the complete stand-up desk to be lifted and moved as one piece. The collars are between 3" and 6" long. The collars are painted or otherwise colored to match the legs.

Spacers 44 are provided to further adjust the height of the desk. There is at least one spacer for each collar, although more could be utilized. The spacers are between ½" and 1" thick and of a circumference to fit within the collar. The spacers may be formed of wood or another suitable material.

In practice, kit 12 is shipped or stored in its retracted or folded position as shown in FIG. 4. In use, kit 12 is expanded into its extended or support position as shown in FIGS. 2 and 6.

Legs 26 and rails 32 are pivoted about hinged legs 30, as they are moved between the retracted or first positions as shown in FIG. 4 to the extended or second positions as shown in FIG. 2. Shelf 40 and foot rail 38 are when secured in position, stabilize the frame of the kit in the extended position. Collars 42 are positioned over legs 26, 28 and 30 and are, preferably, secured by screws. Spacers 44, if needed, are placed in collars 42. Legs 14, 16 and 18 of desk 10 are aligned with and inserted into the upper ends of the collars. If desired, these legs may also be secured to the collars by screws.

The stand-up desk is now assembled and ready for use.

While a preferred embodiment of the invention has been described using specific terms, such description is for illustrative purposes only, and it is to be understood that changes and variations may be made without departing from the spirit or scope of the following claims.

What is claimed is:

1. A conversion kit for adjusting the length of the legs of a desk comprising:

a support frame including a forward pair, a rear pair, and an intermediate pair of leg extensions of selected length fixedly interconnected with side supports, said leg extensions being arranged to be aligned with said legs of said desk;

a plurality of collars adapted to fit over ends of said leg extensions and said legs of said desk for uniting said leg extensions of said support frame with said legs of said desk, said intermediate pair of leg extensions comprising two elongated members pivotally interconnected with a hinge;

a plurality of spacers of selected size which are adapted to be positioned inside said collars between opposed ends of said legs and leg extensions; whereby, the height of said desk is adjusted vertically from a standard height to a variable stand-up height as determined by the length of said leg extensions and said spacers.

2. The kit of claim 1 wherein said kit includes a foot rail adapted to be secured over opposed of said side supports and adjacent said forward pair of said leg extensions.

3. The kit of claim 1 wherein said kit includes a shelf positionable adjacent said intermediate and rear pairs of leg extensions of said support frame.

4. The kit of claim 1 wherein said collars are formed of one of metal, wood, plastic and paper and are colored to match said legs of said desk.

5. A conversion kit for converting a sit-down desk having a plurality of legs into a stand-up desk, said kit comprising:

a frame having a pair of forward, intermediate and rear leg extensions, said frame being convertible between a first retracted position and a second extended position, said intermediate pair of leg extensions comprising two elongated members interconnected with a pivot;

a plurality of collars, said collars being stored within said kit when said frame is in said first retracted position and being engaged with upper ends of said leg extensions when said frame is in said second extended position;

a foot rail contained within said kit when in said first retracted position and connected with said side supports stabilizing said frame with said kit in said second extended position; wherein, said frame is folded into said first contained position for storage/shipping in said retracted position and is opened into said second extended position in which it is operative to engage with and elevate said desk.

6. The kit of claim 5 wherein the pivots of said intermediate leg extensions allow said frame to pivot between said first retracted and second extended positions.

7. The kit of claim 6 further including a shelf, said shelf being engaged between said rear and intermediate of said leg extensions when said frame is in said extended second position.

* * * * *